US011837088B2

(12) United States Patent
Kamakura

(10) Patent No.: US 11,837,088 B2
(45) Date of Patent: Dec. 5, 2023

(54) DRIVING ASSISTANCE APPARATUS

(71) Applicant: Honda Motor Co., Ltd., Tokyo (JP)

(72) Inventor: Hiroshi Kamakura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 4 days.

(21) Appl. No.: 17/884,428

(22) Filed: Aug. 9, 2022

(65) Prior Publication Data

US 2023/0069211 A1 Mar. 2, 2023

(51) Int. Cl.
*G08G 1/0967* (2006.01)

(52) U.S. Cl.
CPC ..... *G08G 1/0967* (2013.01)

(58) Field of Classification Search
CPC ..... G08G 1/0967; G08G 1/052; G08G 1/096783; G08G 1/096741
See application file for complete search history.

(56) References Cited

U.S. PATENT DOCUMENTS 8,773,281 B2 * 7/2014 Ghazarian ..... G08G 1/164 340/903
9,437,110 B2 * 9/2016 Otake ..... G08G 1/096741
11,167,767 B2 * 11/2021 Ishii ..... G08G 1/09623
11,648,937 B2 * 5/2023 Ikezawa ..... B60W 40/04 701/93
2003/0016143 A1 * 1/2003 Ghazarian ..... G08G 1/0962 340/901
2012/0095646 A1 * 4/2012 Ghazarian ..... G01S 19/17 340/905
2014/0285331 A1 * 9/2014 Otake ..... G08G 1/096716 340/435
2018/0154870 A1 * 6/2018 Kurata ..... B60T 7/22
2019/0344801 A1 * 11/2019 Ishii ..... B60W 30/18
2021/0162992 A1 * 6/2021 Ikezawa ..... B60W 50/14
2021/0370964 A1 * 12/2021 Uenoyama ..... B60W 50/14
2022/0319317 A1 * 10/2022 Kamakura ..... H04L 67/12
2023/0069211 A1 * 3/2023 Kamakura ..... G08G 1/096716
2023/0140557 A1 * 5/2023 Kamakura ..... G08G 1/096716 340/435
2023/0154322 A1 * 5/2023 Kamakura ..... D21D 1/38 701/119

FOREIGN PATENT DOCUMENTS

JP 2014096016 A 5/2014

* cited by examiner

*Primary Examiner* — Hoi C Lau
(74) *Attorney, Agent, or Firm* — Duft & Bornsen, PC

(57) ABSTRACT

A driving assistance apparatus including a notification part including a display portion and a microprocessor. The microprocessor is configured to perform deriving a recommended driving recommended to a driver based on traffic light information and position information, controlling the notification part so as to notify the driver of information on the recommended driving, and determining whether the driver performs a driving operation according to the information on the recommended driving after the information on the recommended driving is notified. The microprocessor is configured to perform the controlling including controlling the notification part so that the information on a remaining time for switching of the traffic light included in the traffic light information is displayed on the display portion, when it is determined that the driver performs the driving operation according to the information on the recommended driving.

17 Claims, 5 Drawing Sheets

DRIVING ASSISTANCE APPARATUS

CROSS-REFERENCE TO RELATED APPLICATION

This application is based upon and claims the benefit of priority from Japanese Patent Application No. 2021-138390 filed on Aug. 26, 2021, the content of which is incorporated herein by reference.

BACKGROUND OF THE INVENTION

Field of the Invention

This invention relates to a driving assistance apparatus that supports driving operation of a driver.

Description of the Related Art

Conventionally, as an apparatus of this type, there is a known apparatus that notifies a start timing of accelerator-off operation to a driver of the vehicle traveling on the road where the traffic light is installed. Such an apparatus is described, for example, in Japanese Unexamined Patent Publication No. 2014-096016 (JP2014-096016A). In the apparatus described in JP2014-096016A, a timing of deceleration operation is notified to the driver via the display unit so that the vehicle can pass through the intersection where the traffic light is installed in a non-stop manner.

However, when considering various traffic situations or the like, even if the timing of driving operation as in the apparatus described in JP2014-096016A is notified to the driver, the driver may not be able to perform the driving operation. Therefore, it is desirable to provide a driving operation assistance that seems comfortable for the driver.

SUMMARY OF THE INVENTION

An aspect of the present invention is a driving assistance apparatus including: a notification part including a display portion displaying an information; and an electronic control unit including a microprocessor and a memory connected to the microprocessor. The microprocessor is configured to perform: acquiring traffic light information including switching information on a traffic light and position information representing a position of a vehicle with respect to the traffic light, the traffic light informing a driver of stopping at a predetermined position or traveling without stopping at the predetermined position; deriving a recommended driving recommended to the driver based on the traffic light information and the position information; controlling the notification part so as to notify the driver of information on the recommended driving; and determining whether the driver performs a driving operation according to the information on the recommended driving after the information on the recommended driving is notified by the notification part. The traffic light information acquired by the information acquisition unit includes information on a remaining time until the traffic light in a traveling direction of the vehicle switches from a first mode to a second mode, and the microprocessor is configured to perform the controlling including controlling the notification part so that the information on the remaining time included in the traffic light information is displayed on the display portion, when it is determined that the driver performs the driving operation according to the information on the recommended driving.

BRIEF DESCRIPTION OF THE DRAWINGS

The objects, features, and advantages of the present invention will become clearer from the following description of embodiments in relation to the attached drawings, in which:

FIG. 4A is a diagram showing an example of the display screen when a recommended driving flag is turned on;

FIG. 4B is a diagram showing another example of the display screen when the recommended driving flag is turned on.

DETAILED DESCRIPTION OF THE INVENTION

Figure 1:
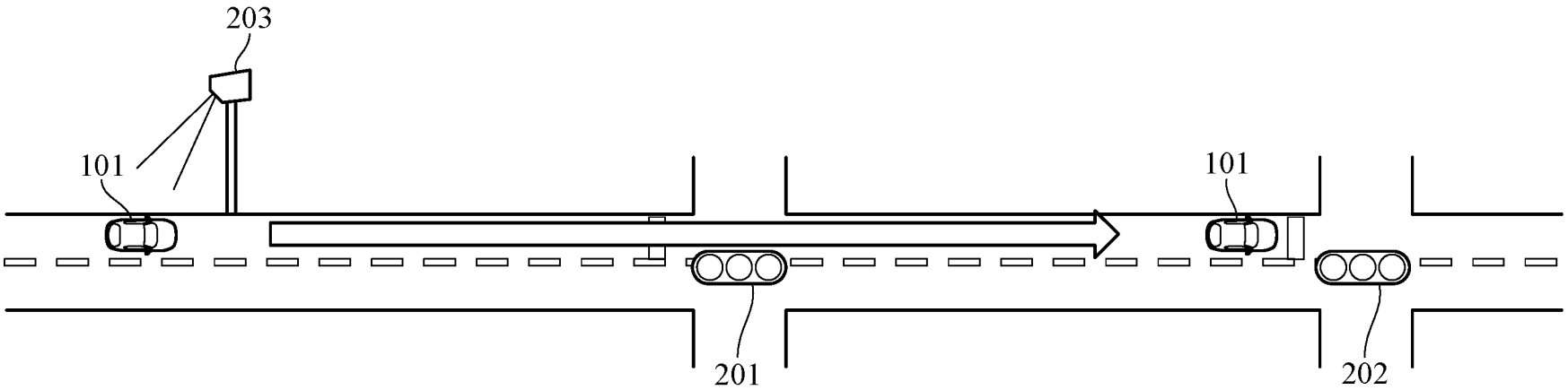
FIG. 1 is a diagram showing an example of a travel scene of a vehicle having a driving assistance apparatus according to an embodiment of the present invention.

Hereinafter, an embodiment of the present invention is explained with reference to FIGS. 1 to 5. FIG. 1 is a diagram showing an example of a travel scene of a vehicle (subject vehicle) having a driving assistance apparatus according to an embodiment of the present invention. FIG. 1 illustrates an example of the vehicle 101 traveling along an arrow on a road on which traffic lights 201 and 202 are installed. The traffic lights 201 and 202 are configured to sequentially switch between red light indicating a stop instruction, green light (blue light) indicating that traveling is possible, and yellow light indicating that traveling is possible but safe stop is difficult at a predetermined cycle. The traffic light may be an arrow traffic light which indicates a travelable direction by an arrow, rather than the light color is switched. The traffic light may be sequentially switched between green light and red light.

The vehicle 101 receives traffic light information on the traffic lights 201 and 202 from a communication device (e.g., an optical beacon roadside unit 203) such as an optical beacon, a radio beacon installed on the side of the road. The traffic light information includes switching information of the traffic lights 201 and 202, for example, switching information such as remaining time until the traffic light 201 switches from green to yellow and from red to green. In FIG. 1, the vehicle 101 passes through the intersection where the traffic light 201 is installed without stopping, and then stops at the intersection where the traffic light 202 is installed.

In the situation where the vehicle 101 travels toward the intersection where the traffic lights 201 and 202 are installed in this way, the driving assistance apparatus according to the embodiment of the present invention is configured to provide predetermined information to the driver of the vehicle 101 based on the traffic light information received from the optical beacon roadside unit 203. That is, the driving assistance apparatus has a driving assistance function for notifying the driver of information (information of a target vehicle speed range) of a vehicle speed range in which the vehicle 101 can pass without stopping at an intersection, information of a deceleration instruction when the vehicle 101 stops at an intersection, and the like.

The information on the vehicle speed range and the information on the deceleration instruction are displayed on a display device provided on an instrument panel facing the driver. A display of a navigation unit disposed at the vicinity of the instrument panel can also be used as the display device. The display device may be configured by a head-up display for projecting an image on a panel provided at a windshield or near the windshield.

Figure 2A:
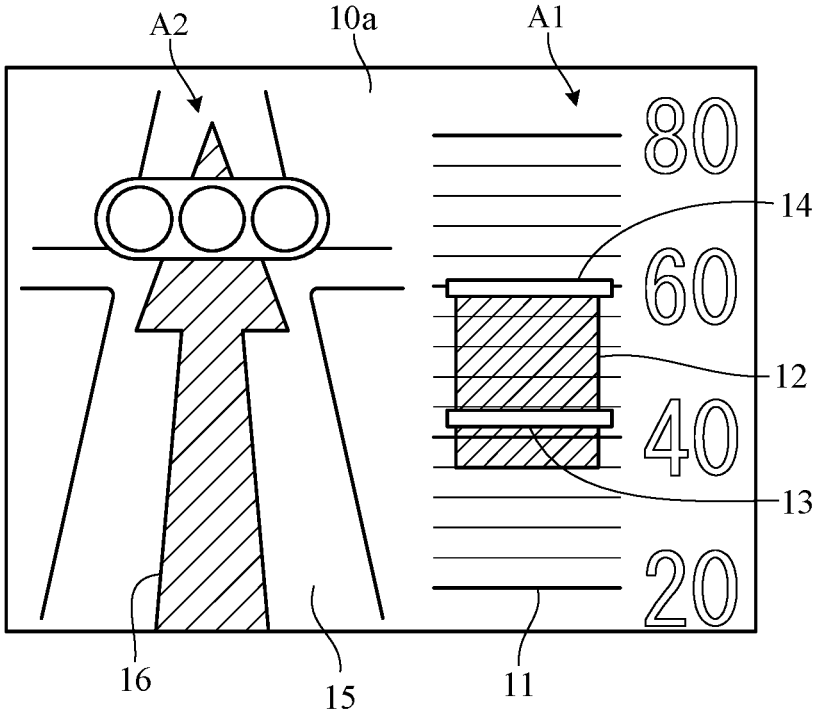
FIG. 2A is a diagram showing an example of a display screen by the driving assistance apparatus according to the embodiment of the present invention.

FIG. 2A is a diagram showing an example of a display screen 10*a* displayed on the display device (monitor) when the vehicle is approaching the traffic light. As shown in FIG. 2A, on the display screen 10*a*, an image indicating the target vehicle speed range is displayed in the area A1 of one of the left and right sides (e.g., the right side), and an image indicating whether or not the vehicle can pass through the intersection where the traffic light is installed without stopping is displayed in the area A2 of another of the left and right sides (e.g., the left side). FIG. 2A corresponds to the display screen 10*a* of the vehicle 101 traveling toward the traffic light 201 in FIG. 1, for example.

The image of the area A1 includes a scale image 11 indicating the vehicle speed on a scale along with a numerical value, a target vehicle speed image 12 (hatching) indicating the target vehicle speed range in which the vehicle can pass through the intersection where the traffic light ahead of the vehicle is installed without stopping, a bar-shaped vehicle speed image 13 indicating the current vehicle speed of the vehicle, and a bar-shaped legal speed image 14 indicating the legal speed of the road. The target vehicle speed image 12, the vehicle speed image 13, and the legal speed image 14 are displayed on the scale image 11 in association with the scale image 11. The monitor has a color display. The scale image 11, the target vehicle speed image 12, the vehicle speed image 13, and the legal speed image 14 are displayed in different colors from each other.

In the area A2, a background image 15 schematically showing a road and a traffic light, and a driving behavior image 16 (hatching) indicating that the vehicle can travel without stopping at the intersection where the traffic light is installed, are displayed. If the vehicle speed is within the target vehicle speed range, the vehicle can travel without stopping at the intersection. In response to this situation, in the example of FIG. 2A, the driving behavior image 16 is represented by an image of an arrow exceeding the traffic light image on the road image of the background image 15. Thus, on the display screen 10*a*, the vehicle speed image 13 indicating the current vehicle speed is displayed in association with the target vehicle speed image 12 indicating the target vehicle speed range, and further, the driving behavior image 16 of the vehicle is displayed. Therefore, the driver can easily grasp necessity of acceleration and deceleration of the vehicle for smoothly passing through the intersection where the traffic light is installed, and good driving assistance for the driver is possible.

Figure 2B:
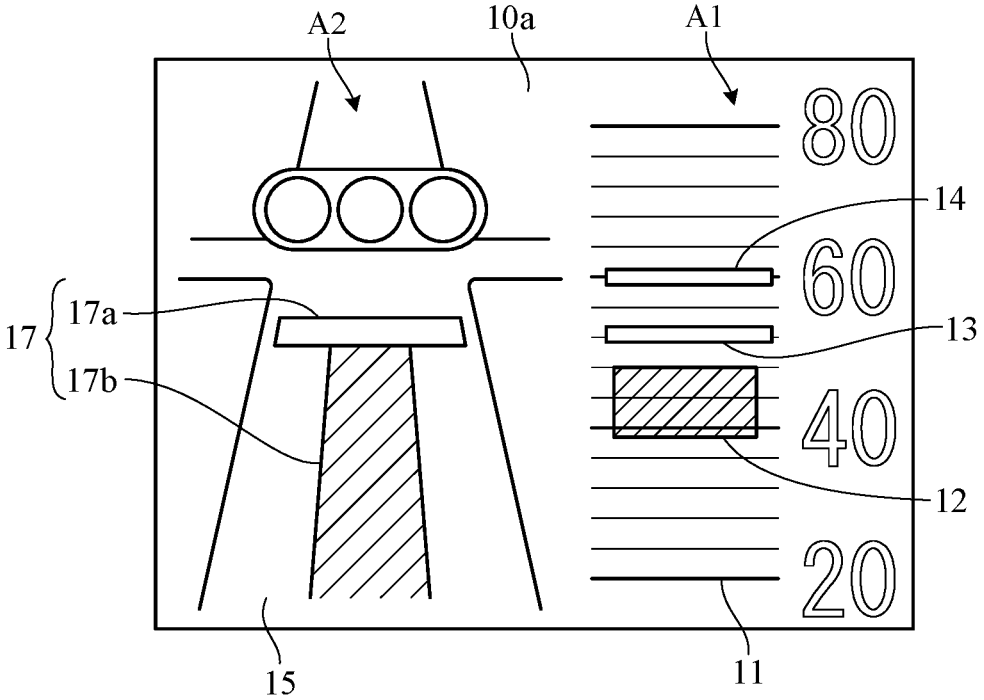
FIG. 2B is a diagram showing another example of the display screen by the driving assistance apparatus according to the embodiment of the present invention.

If the traffic light switches from green to red before the vehicle reaches the traffic light, or if the traffic light is still red when the vehicle reaches the traffic light, the vehicle needs to stop in front of the traffic light. FIG. 2B is a diagram illustrating an example of the display screen 10*a* in such a case. FIG. 2B corresponds to the display screen 10*a* when the vehicle is traveling between the traffic light 201 and the traffic light 202 in FIG. 1, for example.

As shown in FIG. 2B, the target vehicle speed image 12, the vehicle speed image 13, and the legal speed image 14 are displayed in the area A1. The target vehicle speed image 12 is an image showing the target vehicle speed range for the traveling vehicle to stop smoothly on a stop line while suppressing the deceleration to a predetermined value or less. The target vehicle speed image 12 may be omitted. In the area A2, a deceleration instruction image 17 indicating the deceleration instruction of the vehicle is displayed on the background image 15. Specifically, the deceleration instruction image 17 including an image 17*a* of the stop line and a band-shaped image 17*b* as shown by hatching toward the image 17*a* is displayed. Thus, when the deceleration of the vehicle is required to stop the vehicle in front of the traffic light (when the vehicle speed is larger than the target vehicle speed), the deceleration instruction image 17 indicating an instruction of the deceleration operation is displayed on the display screen 10*a*. Accordingly, the driver can easily recognize necessity of the deceleration operation, and can decelerate the subject vehicle at a good timing.

Incidentally, depending on the traffic conditions around the vehicle, even if an image indicating a recommended driving operation such as a target vehicle speed range or a deceleration instruction is displayed, it may be difficult for the driver to follow the operation. For example, when the distance between the vehicle (subject vehicle) and the following vehicle is short, or when other vehicles in the vicinity are traveling at a relatively high speed, if the driver performs the deceleration operation according to the recommended driving operation, there is a possibility that adversely affects the traffic flow. Therefore, it is difficult to perform the driving (recommended driving) according to the recommended driving operation. In such a case, it is difficult to say that the image display of the driving assistance is comfortable for the driver only by continuously displaying the image of the recommended driving operation. Therefore, in the embodiment, a driving assistance apparatus is configured as follows.

Figure 3:
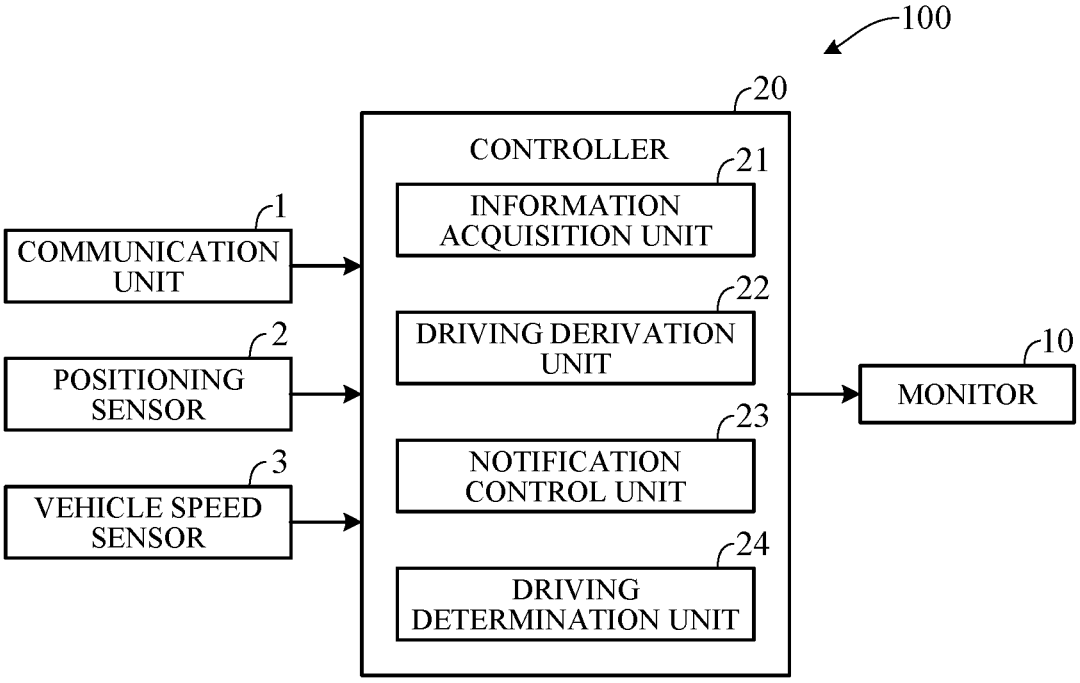
FIG. 3 is a block-diagram illustrating a configuration of a main part of the driving assistance apparatus according to the embodiment of the present invention.

FIG. 3 is a block-diagram schematically illustrating a configuration of a main part of the driving assistance apparatus 100 according to the embodiment of the present invention. As shown in FIG. 3, the driving assistance apparatus 100 includes a controller 20, and a communication unit 1, a positioning sensor 2, a vehicle speed sensor 3 and a monitor 10 which are communicably connected to the controller 20, respectively.

The communication unit 1 is configured to be capable of wirelessly communicating with the optical beacon roadside unit 203 (FIG. 1) provided on the road, that is, capable of road-to-vehicle communication. The communication unit 1 receives, from the communication device provided in the optical beacon roadside unit 203, the traffic light information on the traffic light located in the traveling direction of the vehicle, i.e., the traffic light information on the traffic light installed at the intersection where the vehicle passes next. The traffic light information includes position information of the traffic light and information on the switching time of the light color of the traffic light. The information on the switching time includes information on the remaining time until the traffic light is switched from green to yellow when the traffic light is currently green, and information on the remaining time until the traffic light is switched to green next when the traffic light is not currently green (for example, red).

The positioning sensor 2 receives signal for positioning transmitted from the positioning satellite. Positioning satellites are artificial satellites such as GPS satellites and quasi-zenith satellites. Using positioning information received by the positioning sensor 2, the current position of the vehicle (latitude, longitude, altitude) is measured. The positioning sensor 2 is used to detect the position (distance to the signal, etc.) of the vehicle relative to the position of the intersection where the traffic light is installed. Therefore, it is also possible to use a distance detector (radar, LIDAR, etc.) for detecting the distance from the vehicle to the object (object in the vicinity of the intersection) in place of the positioning sensor 2. The vehicle speed sensor 3 detects the vehicle speed of the vehicle.

The controller 20 executes a predetermined processing based on signal from the communication unit 1, the positioning sensor 2 and the vehicle speed sensor 3, and outputs control signal to the monitor 10 having the display screen 10*a*. The controller 20 is constituted by an electronic control unit (ECU). More specifically, the controller 20 incorporates a computer including a CPU or other processing unit (a microprocessor), the memory unit (a memory) of RAM, ROM and the like, and an input/output interface or other peripheral circuits not shown in the drawings. The controller 20 includes an information acquisition unit 21, a driving derivation unit 22, a notification control unit 23 and a driving determination unit 24 as functional configurations.

The information acquisition unit 21 acquires the traffic light information received by the communication unit 1, the information (position information) on the current position of the vehicle detected by the positioning sensor 2, and the information (vehicle speed information) on the vehicle speed of the vehicle detected by the vehicle speed sensor 3. Further, the information acquisition unit 21 identifies the road on which the vehicle is traveling, in accordance with the position information of the vehicle, and acquires information on the legal speed (legal speed information) corresponding to the road on the basis of the road information stored in advance in the memory.

The driving derivation unit 22 derives a recommended driving recommended to the driver, based on the traffic light information, the position information, the vehicle speed information, and the legal speed information acquired by the information acquisition unit 21. Specifically, the driving derivation unit 22 calculates the distance from the vehicle to the intersection where the traffic light is installed based on the position information, and calculates a range of the vehicle speed in which the vehicle can pass without stopping at the intersection, based on the calculated distance and the remaining time until the traffic light ahead of the vehicle switches from green to yellow included in the traffic light information. Then, among the range of the vehicle speed, the driving derivation unit 22 calculates a range of the vehicle speed equal to or lower than the legal vehicle speed as a target vehicle speed range. The target vehicle speed range is included in the recommended driving recommended to the driver.

On the other hand, the driving derivation unit 22 calculates a range of the target vehicle speed for the vehicle to stop smoothly in front of the traffic light when it is determined that the vehicle cannot pass through the intersection without stopping at the vehicle speed equal to or lower than the legal vehicle speed. Then, the driving derivation unit 22 derives a deceleration instruction including the range of the target vehicle speed as the recommended driving when the vehicle speed of the vehicle included in the vehicle speed information exceeds the target vehicle speed. Alternatively, the driving derivation unit 22 simply derives the deceleration instruction for stopping in front of the traffic light without calculating the range of the target vehicle speed.

The notification control unit 23 controls the monitor 10 so as to display the recommended driving derived by the driving derivation unit 22. For example, when it is determined by the driving derivation unit 22 that the vehicle can pass through the intersection without stopping, the notification control unit 23 controls the monitor 10 such that, as shown in FIG. 2A, the target vehicle speed image 12, the vehicle speed image 13 and the legal speed image 14 are displayed in association with the scale image 11, and further, the driving behavior image 16 indicating that the vehicle can pass through the intersection without stopping is displayed on the background image 15. On the other hand, if it is determined by the driving derivation unit 22 that the vehicle cannot pass through the intersection without stopping, the notification control unit 23 controls the monitor 10 such that, as shown in FIG. 2B, the target vehicle speed image 12, the vehicle speed image 13 and the legal speed image 14 are displayed in association with the scale image 11, and further, the deceleration instruction image 17 indicating the deceleration operation instruction is displayed on the background image 15.

After the information on the recommended driving is informed to the driver via the monitor 10, the driving determination unit 24 determines whether or not the recommended driving according to the informed recommended driving information is performed by the driver. That is, the driving determination unit 24 determines whether or not the driver performs the driving operation for traveling in the target vehicle speed range in response to the display of the target vehicle speed range shown in FIG. 2A and FIG. 2B. When it is determined by the driving determination unit 24 that the driving operation according to the recommended driving information is performed, the notification control unit 23 controls the monitor 10 so that additional information is displayed on the display screen 10*a*.

Figure 4A:
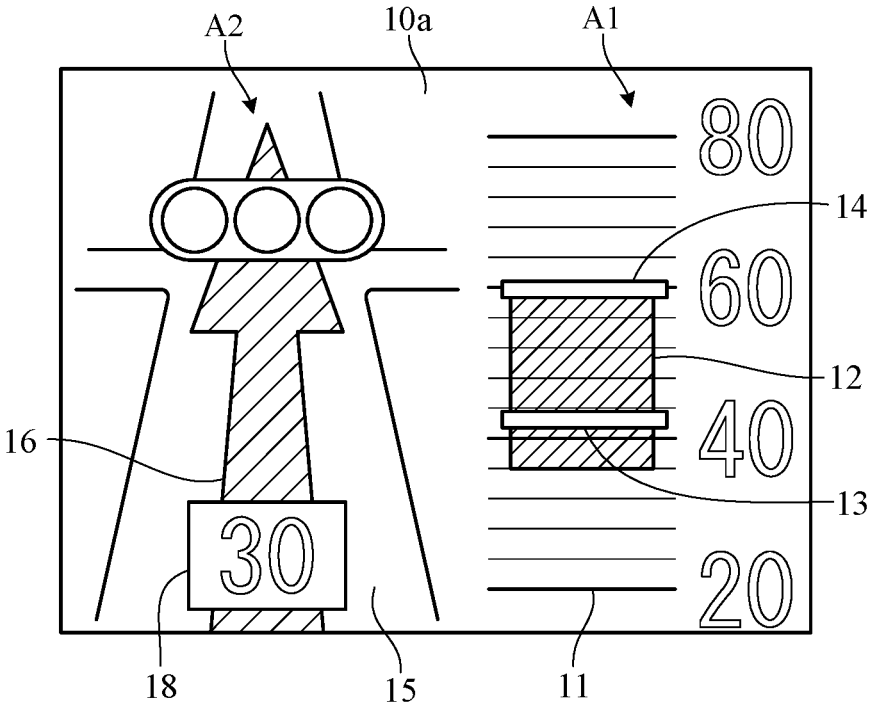

FIG. 4A is a diagram showing an example in such a case, i.e., an example of the display when the vehicle can pass through the intersection with the green light. In FIG. 4A, the notification control unit 23 controls the monitor 10 so that the information on the remaining time (the green light remaining time) until the traffic light ahead of the vehicle switches from green to yellow, calculated by the driving derivation unit 22, i.e., the remaining time image 18, is displayed on the driving behavior image 16 in the area A2. Specifically, the green light remaining time (seconds) is displayed as a numerical value.

The green light remaining time is counted down to 0 as time elapses. For example, a countdown display every second (30→29→28 . . . ), a countdown display every 2 seconds (30→28→26 . . . ), or a countdown display every other second is performed. Instead of or in addition to displaying the green light remaining time with numerical value, the green light remaining time may be displayed by a bar graph or the like. In this case, the length of the bar graph may be shortened (for example, decreased by one step) with the lapse of time, and the length may be set to 0 when the green light remaining time becomes 0 second.

In this way, when the driver performs the driving operation in accordance with the recommended driving, the remaining time image 18 is additionally displayed. Therefore, the driver can grasp the time until the traffic light is switched, thereby grasping how much margin there is until the traffic light is switched (degree of margin). As a result, the driver can perform the driving operation with the psychological margin. Rather than displaying the remaining time image 18 until the green light remaining time is 0 seconds, when the green light remaining time reaches a predetermined time (e.g., 6 seconds), the remaining time image 18 may be hidden. Accordingly, it is possible to prevent the driver from being impatience near the intersection. When the remaining time image 18 is displayed, the target vehicle speed image 12 may be hidden in order to reduce the troublesomeness of display.

Once the driver performs the driving operation in accordance with the recommended driving, the notification control unit 23 controls the monitor 10 so as to perform continuously over a predetermined period a processing of displaying the remaining time image 18. As a premise, the driving determination unit 24, for example, determines whether or not the driver has performed the recommended driving from the start of displaying the recommended driving image (target vehicle speed image 12) to the intersection where the first signal (e.g., traffic light 201 in FIG. 1) is installed, or determines whether or not the driver has performed the recommended driving from the intersection where the first signal is installed to the intersection where the next signal (e.g., traffic light 202 in FIG. 1) is installed, based on the vehicle speed information or the like. That is, the driving determination unit 24 determines whether or not the driver has performed the recommended driving operation.

When determining that the recommended driving operation has been performed, the driving determination unit 24 turns on the recommended driving flag. Once the recommended driving flag is turned on, it is continuously turned on for a predetermined time period (e.g., until the end of the day), regardless of whether or not the recommended driving operation has been performed, and is turned off when the day ends. The notification control unit 23 controls the monitor 10 to display the remaining time image 18 when the recommended operation flag is turned on, and to stop the display of the remaining time image 18 when the recommended operation flag is turned off. Instead of setting the predetermined time period in days, the predetermined time period may be set in times. The period from when the recommended driving flag is turned on to when the driver gets off after completion of the vehicle traveling operation may be set as the predetermined time period.

Figure 4B:
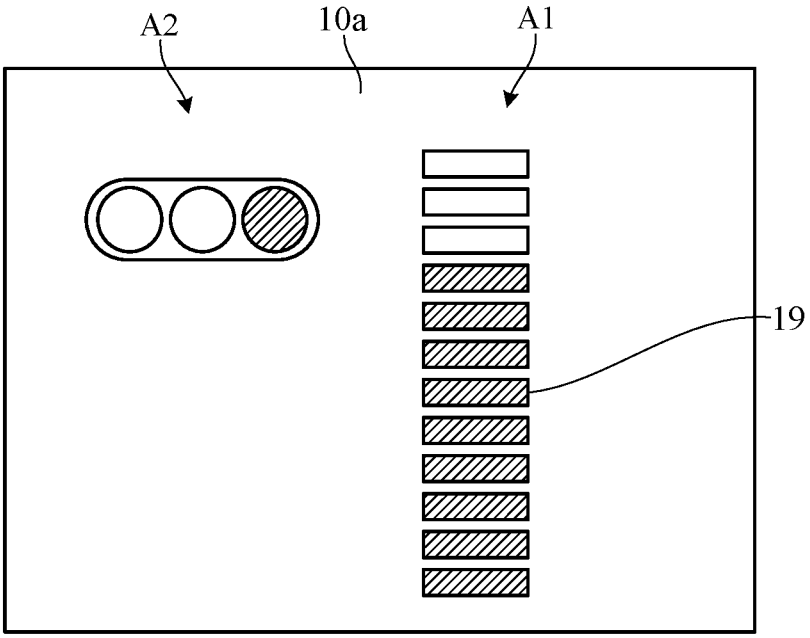

FIG. 4B is a diagram illustrating an example of additional information displayed on the display screen 10*a* when the vehicle is stopped at the intersection of the red light after the driver has performed the recommended driving according to the recommended driving information. In FIG. 4B, the notification control unit 23 controls the monitor 10 so that the information on the remaining time until the traffic light ahead of the vehicle switches from red to green (red signal remaining time), calculated by the driving derivation unit 22, i.e., the remaining time image 19 is displayed in the area A1. Specifically, the notification control unit 23 controls the monitor 10 so that the red light remaining time (second) is displayed in a bar graph (hatching). The bar graph becomes shorter in length by one stage with the lapse of time, and the length becomes 0 when the red light remaining time becomes 0. Instead of or in addition to the bar graph display, the red light remaining time may be displayed as a numerical value. In FIG. 4B, since the vehicle is stopped, the deceleration instruction image 17 in the area A2 (FIG. 2B) is not displayed. However, if the vehicle is traveling, the deceleration instruction image 17 is displayed together with the remaining time image 19. In this case, the target vehicle speed image 12, the vehicle speed image 13 and the legal speed image 14 may be displayed so as not to interfere with the display of the remaining time image 19.

In this way, when the driver performs the driving operation in accordance with the recommended driving, the remaining time image 19 is additionally displayed. Therefore, the driver can grasp the time until the traffic light is switched, i.e. how much margin there is until the traffic light is switched (degree of margin). As a result, it is easy for the driver to make preparations to start the vehicle smoothly. When the red light remaining time reaches a predetermined time (e.g., 6 seconds), a predetermined notification sound may be output to the driver. Thus, the driver can grasp the remaining time until switching to the green light even without gazing at the monitor 10, and it is possible to effectively utilize the time for waiting at the traffic light. When the red light remaining time reaches a predetermined time (e.g., 6 seconds), the notification control unit 23 may hide the remaining time image 19.

Once the driver performs the driving operation in accordance with the recommended driving, the notification control unit 23 controls the monitor 10 to perform continuously over a predetermined time period the processing of displaying the remaining time image 19. As a premise, the driving determination unit 24, for example, determines whether or not the vehicle is decelerated without once accelerating from the display start of the recommended driving image (deceleration instruction image 17) to the intersection where the first traffic light (e.g., traffic light 201 in FIG. 1) is installed, or determines whether or not the vehicle is decelerated and stopped without once accelerating from the intersection where the first traffic light is installed to the intersection where the next traffic light (e.g., traffic light 202 in FIG. 1) is installed, based on the vehicle speed information. That is, the driving determination unit 24 determines whether or not the driver has performed the recommended driving operation.

When determining that the recommended driving operation has been performed, the driving determination unit 24 turns on the recommended driving flag. Once the recommended driving flag is turned on, it is continuously turned on for a predetermined period of time (e.g., until the end of the day), regardless of whether or not the recommended driving operation has been performed, and is turned off when the day ends. The notification control unit 23 controls the monitor 10 to display the remaining time image 19 when the recommended operation flag is turned on, and to stop the display of the remaining time image 19 when the recommended operation flag is turned off. Instead of setting the predetermined time period in days, the predetermined time period may be set in times. The period from when the recommended driving flag is turned on to when the driver gets off after completion of the vehicle traveling operation may be set as the predetermined period.

Figure 5:
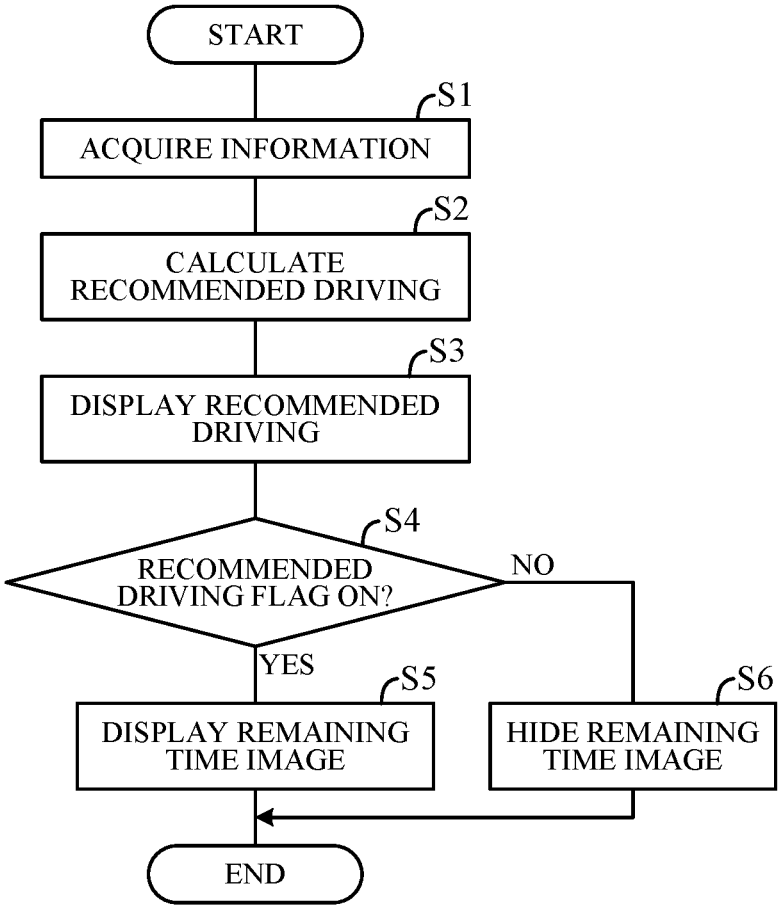
FIG. 5 is a flowchart illustrating an example of processing executed by a controller in FIG. 3.

FIG. 5 is a flow chart illustrating an example of the processing executed by the controller 20 in FIG. 3. The processing illustrated in this flowchart is started by, for example, turning on the power key switch, and is repeated at a predetermined cycle corresponding to the operating frequency of the CPU.

As shown in FIG. 5, first, in S1 (S: processing step), the CPU acquires the traffic light information received by the communication unit 1, as well as the position information of the vehicle obtained by the signal from the positioning sensor 2 and the vehicle speed information obtained by the signal from the vehicle speed sensor 3. The traffic light information includes information on the remaining time (green light remaining time or red light remaining time) until the traffic light switches from green to yellow or from red to green. Further, in S1, the CPU refers to the road information stored in the memory in advance and acquires information on the legal speed of the road on which the vehicle is traveling. The CPU may acquire the legal speed information of the road on which the vehicle is traveling, by recognizing the road sign by an in-vehicle camera.

Then, in S2, based on the traffic light information, the position information and the legal speed information acquired in S1, the CPU calculates the target vehicle speed range of the vehicle with the legal speed as the upper limit as the recommended driving to the driver. More specifically, the CPU calculates the target vehicle speed range in which the vehicle can pass through the intersection without stopping at the intersection where the traffic light is installed, or the target vehicle speed range in the case where the vehicle stops in front of the traffic light.

Next, in S3, the CPU outputs control signal to the monitor 10 so as to display the image of the recommended driving including the target vehicle speed range calculated in S2. For example, the CPU outputs control signal to the monitor 10 so as to display the target vehicle speed image 12, the vehicle speed image 13, and the legal speed image 14 in association with the scale image 11 in the area A1, and the driving behavior image 16 or the deceleration instruction image 17 on the background image 15.

Then, in S4, the CPU determines whether or not the recommended driving flag is ON. That is, the CPU determines whether or not the driver has performed the driving operation corresponding to the display of the recommended driving image in S3, based on the vehicle speed information acquired in S1. The recommended driving flag is turned on when the driver performs the driving operation in accordance with the recommended driving image, within the predetermined period after the start of the driving operation of the driver, i.e., the predetermined period until the vehicle passes through the first traffic light or the second traffic light after the recommended driving image is displayed. The determination as to whether or not the recommended driving flag is ON is a determination as to whether or not the driver is willing to perform the driving operation according to the recommended driving image. That is, when the driving operation according to the recommended driving image is performed in a predetermined period after the start of the driving operation, it is estimated that the driver is willing to perform the driving operation according to the recommended driving image. In this case, the recommended operation flag continues to be turned on for a certain period of time, for example, until the end of the day. If the determination in S4 is YES, the processing proceeds to S5; otherwise, the processing proceed to S6.

In S5, the CPU controls the monitor 10 so that the remaining time image 18 indicating the green light remaining time or the remaining time image 19 indicating the red light remaining time is additionally displayed on the display screen 10*a* based on the traffic light information acquired in S1. Thus, the driver can grasp the remaining time until the traffic light switches, and useful information is obtained for the driver performing the driving operation according to the recommended driving image. Meanwhile, in S6, the CPU controls the monitor 10 so that the remaining time images 18 and 19 are not displayed. Accordingly, it is possible to prevent a large amount of information from being provided to the driver who does not perform the driving operation according to the recommended driving image.

The operation of the driving assistance apparatus 100 according to the present embodiment is summarized as follows. As shown in FIG. 1, after the driver starts the daily driving operation, when the vehicle 101 approaches the first traffic light 201, the image as shown in FIG. 2A as an example is displayed on the display screen 10*a* of the monitor 10. Specifically, along with the image indicating the vehicle speed range for the vehicle passing through the intersection with the traffic light 201 without stopping, that is, the target vehicle speed image 12 indicating the target vehicle speed range, the driving behavior image 16 indicating that the vehicle can pass through the intersection without stopping, are displayed (S3). At this time, when the driver performs the driving operation so that the vehicle travels within the target vehicle speed range, the recommended driving flag is turned on, and thus as shown in FIG. 4A, the remaining time image 18 indicating the green light remaining time is displayed (S5). Thus, the driver can grasp the remaining time until the green light is switched to the yellow light, and it is possible to perform the driving operation with a margin when passing through the intersection.

On the other hand, when the vehicle 101 stops at the red light in front of the traffic light 202 after passing through the intersection with the traffic light 201 in the non-stop, as shown in FIG. 2B as an example, the deceleration instruction image 17 indicating the deceleration instruction together with the target vehicle speed image 12 are displayed on the display screen 10*a* (S3). At this time, when the driver performs the driving operation so that the vehicle decelerates and travels within the target vehicle speed range, the recommended driving flag is turned on. Then, at the time of stopping at the red light, as shown in FIG. 4B, the remaining time image 19 indicating the red light remaining time is displayed (S5). Thus, the driver can grasp the remaining time until the traffic light switches from red light to the green light, and it is possible to effectively utilize the waiting time for the traffic light without causing the start delay of the vehicle.

The present embodiment can achieve advantageous effects as follows:

(1) The driving assistance apparatus 100 includes: an information acquisition unit 21 acquiring the traffic light information including the switching information on the traffic light and the position information representing the position of the vehicle with respect to the traffic light; a driving derivation unit 22 deriving the recommended driving recommended to the driver, based on the traffic light information and the position information acquired by the information acquisition unit 21; a monitor 10 displaying the information; a notification control unit 23 controlling the monitor 10 so as to notify the driver of the information on the recommended driving derived by the driving derivation unit 22; and a driving determination unit 24 determining whether or not the driver performs the driving operation according to the information on the recommended driving, after the information on the recommended driving is notified by the monitor 10 (FIG. 3). The traffic light information acquired by the information acquisition unit 21 includes information on the remaining time of the green light until the traffic light in the traveling direction of the vehicle switches from green to yellow and the information on the remaining time of the red light until the traffic light switches from red to green. The notification control unit 23 controls the monitor 10 so that the information on the green light remaining time or the red light remaining time included in the traffic light information is displayed on the monitor 10 when it is determined by the driving determination unit 24 that the driver performs the driving operation according to the information on the recommended driving (FIG. 5).

Thus, when the driver performs the driving operation in accordance with the recommended driving, by displaying the information on the remaining time until switching of the traffic light on the monitor 10, the driver can easily grasp the remaining time until switching of the traffic light. Therefore, even when the driver can no longer perform the driving operation according to the recommended driving due to the traffic situation or the like after performing the driving operation according to the recommended driving, it is possible to provide useful information on the traffic light to the driver. As a result, the comfort for the driver for driving operation assistance is improved. If the surrounding traffic flow is appropriate, by providing further information on the traffic light, the safety of traffic can be improved and a sustainable transport system can be constructed.

(2) The recommended driving includes a range of target vehicle speeds within which the vehicle can pass through the intersection. The notification control unit 23 controls the monitor 10 so that the information on the green light remaining time (remaining time image 18) is displayed on the monitor 10, when it is determined by the driving determination unit 24 that the driver is performing the driving operation to run the vehicle in the range of the target vehicle speed (FIG. 4A). This makes it possible for the driver to grasp the green light remaining time. Therefore, even if the vehicle cannot travel within the range of the target vehicle speed, the vehicle can pass through the intersection in the non-stop by the driving operation with a margin.

(3) The recommended driving includes the deceleration instruction of the vehicle. The notification control unit 23 controls the monitor 10 so that the information on the red light remaining time (remaining time image 19) at the time of stopping at the red light is displayed on the monitor 10 when it is determined by the driving determination unit 24 that the driver is performing the driving operation according to the deceleration instruction (FIG. 4B). This makes it possible for the driver to grasp the red light remaining time while the vehicle stops at the red light. Therefore, it is possible to effectively utilize the time for waiting at the traffic light without causing the start delay when the traffic light switches to the green light.

(4) When it is determined by the driving determination unit 24 that the driver is performing the driving operation in accordance with the information on the recommended driving, the notification control unit 23 controls the monitor 10 so as to perform continuously over the predetermined period the processing for displaying the information on the green signal remaining time or red signal remaining time included in the traffic light information on the monitor 10. That is, once it is determined that the driving operation according to the information on the recommended driving is performed, the recommended driving flag is turned on, and thereafter, regardless of whether or not the driving operation according to the information on the recommended driving is performed, the display of the remaining time is continuously performed over the predetermined period. Therefore, when the recommended driving flag is turned on, thereafter it is not necessary to determine whether or not the driving operation is performed according to the information on the recommended driving for the predetermined period. Thus, even in a case where the driving operation according to the recommended driving information cannot be performed due to the influence of the surrounding traffic conditions or the like, it is possible to provide useful information on the traffic light to the driver.

The above embodiment can be modified to various forms. Several modifications will be described below. In the above embodiment, the information acquisition unit 21 acquires information such as the traffic light information including the switching information of the traffic light and the position information representing the position of the vehicle with respect to the traffic light. However, an information acquisition unit acquires other information (e.g. congestion information) useful when the vehicle passes through the intersection with the traffic light, and the driving derivation unit 22 may derive a recommended driving recommended to the driver based on this information. In the above embodiment, the position of the vehicle is detected by the positioning sensor 2. However, the position of the vehicle relative to the traffic light may be detected using a radar, a LIDAR, or a camera.

In the above embodiment, the driving derivation unit 22 derives the recommended driving recommended to the driver based on the traffic light information and the position information of the vehicle acquired by the information acquisition unit 21. Specifically, the range of the vehicle speed to be satisfied by the vehicle (target vehicle speed range) and the instruction to perform the deceleration operation (deceleration instruction) are derived as part of the recommended driving. However, other recommended driving such as an instruction of lane change may be derived, and thus the configuration of a derivation unit is not limited to those described above. In the above embodiment, the information on the recommended driving derived by the driving derivation unit 22 is notified to the driver via the monitor 10 (display portion). However, the configuration of a notification part is not limited thereto. For example, it may be configured to notify the driver by an audio output.

In the above embodiment, on condition that the driving determination unit 24 as a determination unit determines that the driver performs the driving operation according to the recommended driving information, the information on the remaining time (the green light remaining time or the red light remaining time) included in the traffic light information is displayed on the monitor 10. However, the form of the display of the information on the remaining time is not limited to the above one. Therefore, when it is determined by a determination unit that the driver is performing the driving operation according to the information on the recommended driving, as long as the information of the remaining time included in the traffic light information is displayed on the display portion by controlling the notifying part, the configuration of a notification control unit may be any one.

In the above embodiment, the information on the remaining time until the traffic light switches from green as a first mode to yellow as a second mode and the remaining time until the traffic light switches from red as the first mode to green as the second mode is configured as the traffic light information acquired by the information acquisition unit 21. However, the traffic light information is not limited thereto. That is, the first mode may not be a mode indicating that the vehicle can travel or a mode indicating that the vehicle should stop. In the above embodiment, when it is determined by the driving determination unit 24 that the driver is performing the driving operation according to the recommended driving information, the process of displaying the information on the remaining time included in the traffic light information on the monitor 10 is continuously performed for the predetermined period (the day on which the determination is made). However, the driver may be able to set a predetermined period.

In the above embodiment, the configuration of the driving assistance apparatus 100 is described by referring to the case where the vehicle passes through the intersection where the traffic light is installed. However, the traffic light may be installed in not only the intersection but also a pedestrian crossing or the like. In this case also, the driving assistance apparatus of the present invention can be applied.

The present invention can also be used as a driving assistance method including: acquiring traffic light information including switching information on a traffic light and position information representing a position of a vehicle with respect to the traffic light, the traffic light informing a driver of stopping at a predetermined position or traveling without stopping at the predetermined position; deriving a recommended driving recommended to the driver based on the traffic light information and the position information; controlling the notification part having a display portion so as to notify the driver of information on the recommended driving; and determining whether the driver performs a driving operation according to the information on the recommended driving after the information on the recommended driving is notified by the notification part, wherein the traffic light information includes information on a remaining time until the traffic light in a traveling direction of the vehicle switches from a first mode to a second mode, and the controlling includes controlling the notification part so that the information on the remaining time included in the traffic light information is displayed on the display portion, when it is determined that the driver performs the driving operation according to the information on the recommended driving.

The above embodiment can be combined as desired with one or more of the above modifications. The modifications can also be combined with one another.

According to the present invention, it is possible to provide a driving operation assistance that seems comfortable for the driver.

Above, while the present invention has been described with reference to the preferred embodiments thereof, it will be understood, by those skilled in the art, that various changes and modifications may be made thereto without departing from the scope of the appended claims.

What is claimed is:

1. A driving assistance apparatus comprising:

a notification part including a display portion displaying an information; and an electronic control unit including a microprocessor and a memory connected to the microprocessor, wherein the microprocessor is configured to perform:

acquiring traffic light information including switching information on a traffic light and position information representing a position of a vehicle with respect to the traffic light, the traffic light informing a driver of stopping at a predetermined position or traveling without stopping at the predetermined position;

deriving a recommended driving recommended to the driver based on the traffic light information and the position information;

controlling the notification part so as to notify the driver of information on the recommended driving; and determining whether the driver performs a driving operation according to the information on the recommended driving after the information on the recommended driving is notified by the notification part, the traffic light information acquired by the information acquisition unit includes information on a remaining time until the traffic light in a traveling direction of the vehicle switches from a first mode to a second mode, and the microprocessor is configured to perform the controlling including controlling the notification part so that the information on the remaining time included in the traffic light information is displayed on the display portion, when it is determined that the driver performs the driving operation according to the information on the recommended driving.

2. The driving assistance apparatus according to claim 1, wherein the first mode is a mode representing that the vehicle is allowed to travel without stopping at the predetermined position, the recommended driving includes a range of a target vehicle speed when the vehicle travels without stopping at the predetermined position, and the microprocessor is configured to perform the controlling including controlling the notification part so that the information on the remaining time is displayed on the display portion, when it is determined that the driver performs a driving operation so that the vehicle travels within the range of the target vehicle speed.

3. The driving assistance apparatus according to claim 2, wherein the microprocessor is configured to perform the controlling including controlling the notification part so that the information on the remaining time is displayed on the display portion in accordance with a driving behavior image representing that the vehicle is allowed to travel without stopping at the predetermined position, when it is determined that the driver performs the driving operation so that the vehicle travels within the range of the target vehicle speed.

4. The driving assistance apparatus according to claim 1, wherein the first mode is a mode representing that the vehicle is to stop at the predetermined position, the recommended driving includes a deceleration instruction when the vehicle stops at the predetermined position, and the microprocessor is configured to perform the controlling including controlling the notification part so that the information on the remaining time is displayed on the display portion, when it is determined that the driver performs a driving operation in accordance with the deceleration instruction.

5. The driving assistance apparatus according to claim 1, wherein the microprocessor is configured to perform the controlling including controlling the notification part so as to perform continuously over a predetermined period a processing to display the information on the remaining time included in the traffic light information on the display portion, when it is determined that the driver performs the driving operation according to the information on the recommended driving.

6. The driving assistance apparatus according to claim 5, wherein the microprocessor is configured to perform the controlling including controlling the notification part so as to perform continuously over the predetermined period the processing to display the information on the remaining time included in the traffic light information on the display portion regardless whether the driver performs the driving operation according to the information on the recommended driving, after once it is determined that the driver performs the driving operation according to the information on the recommended driving.

7. The driving assistance apparatus according to claim 6, wherein the microprocessor is configured to perform the determining including not determining whether the driver performs the driving operation according to the information on the recommended driving until the predetermined period elapses, after determining whether the driver performs the driving operation according to the information on the recommended driving notified by the notification part first during one day.

8. The driving assistance apparatus according to claim 1, wherein the microprocessor is configured to perform the controlling including controlling the notification part so that the information on the remaining time is hidden, when the remaining time becomes shorter than or equal to a predetermined time under a situation where the information on the remaining time is displayed on the display portion.

9. A driving assistance apparatus comprising:

a notification part including a display portion displaying an information; and an electronic control unit including a microprocessor and a memory connected to the microprocessor, wherein the microprocessor is configured to function as:

an information acquisition unit that acquires traffic light information including switching information on a traffic light and position information representing a position of a vehicle with respect to the traffic light, the traffic light informing a driver of stopping at a predetermined position or traveling without stopping at the predetermined position;

a derivation unit that derives a recommended driving recommended to the driver, based on the traffic light information and the position information acquired by the information acquisition unit;

a notification control unit that controls the notification part so as to notify the driver of information on the recommended driving derived by the derivation unit; and a determination unit that determines whether the driver performs a driving operation according to the information on the recommended driving after the information on the recommended driving is notified by the notification part, the traffic light information acquired by the information acquisition unit includes information on a remaining time until the traffic light in a traveling direction of the vehicle switches from a first mode to a second mode, and the notification control unit controls the notification part so that the information on the remaining time included in the traffic light information is displayed on the display portion, when it is determined by the determination unit that the driver performs the driving operation according to the information on the recommended driving.

10. The driving assistance apparatus according to claim 9, wherein the first mode is a mode representing that the vehicle is allowed to travel without stopping at the predetermined position, the recommended driving includes a range of a target vehicle speed when the vehicle travels without stopping at the predetermined position, and the notification control unit controls the notification part so that the information on the remaining time is displayed on the display portion, when it is determined by the determination unit that the driver performs a driving operation so that the vehicle travels within the range of the target vehicle speed.

11. The driving assistance apparatus according to claim 10, wherein the notification control unit controls the notification part so that the information on the remaining time is displayed on the display portion in accordance with a driving behavior image representing that the vehicle is allowed to travel without stopping at the predetermined position, when it is determined by the determination unit that the driver performs the driving operation so that the vehicle travels within the range of the target vehicle speed.

12. The driving assistance apparatus according to claim 9, wherein the first mode is a mode representing that the vehicle is to stop at the predetermined position, the recommended driving includes a deceleration instruction when the vehicle stops at the predetermined position, and the notification control unit controls the notification part so that the information on the remaining time is displayed on the display portion, when it is determined by the determination unit that the driver performs a driving operation in accordance with the deceleration instruction.

13. The driving assistance apparatus according to claim 9, wherein the notification control unit controls the notification part so as to perform continuously over a predetermined period a processing to display the information on the remaining time included in the traffic light information on the display portion, when it is determined by the determination unit that the driver performs the driving operation according to the information on the recommended driving.

14. The driving assistance apparatus according to claim 13, wherein the notification control unit controls the notification part so as to perform continuously over the predetermined period the processing to display the information on the remaining time included in the traffic light information on the display portion regardless whether the driver performs the driving operation according to the information on the recommended driving, after once it is determined by the determination unit that the driver performs the driving operation according to the information on the recommended driving.

15. The driving assistance apparatus according to claim 13, wherein the determination unit does not determine whether the driver performs the driving operation according to the information on the recommended driving until the predetermined period elapses, after determining whether the driver performs the driving operation according to the information on the recommended driving notified by the notification part first during one day.

16. The driving assistance apparatus according to claim 9, wherein the notification control unit controls the notification part so that the information on the remaining time is hidden, when the remaining time becomes shorter than or equal to a predetermined time under a situation where the information on the remaining time is displayed on the display portion.

17. A driving assistance method comprising:

acquiring traffic light information including switching information on a traffic light and position information representing a position of a vehicle with respect to the traffic light, the traffic light informing a driver of stopping at a predetermined position or traveling without stopping at the predetermined position;

deriving a recommended driving recommended to the driver based on the traffic light information and the position information;

controlling the notification part having a display portion so as to notify the driver of information on the recommended driving; and determining whether the driver performs a driving operation according to the information on the recommended driving after the information on the recommended driving is notified by the notification part, wherein the traffic light information includes information on a remaining time until the traffic light in a traveling direction of the vehicle switches from a first mode to a second mode, and the controlling includes controlling the notification part so that the information on the remaining time included in the traffic light information is displayed on the display portion, when it is determined that the driver performs the driving operation according to the information on the recommended driving.

* * * * *